United States Patent [19]

Wheeler

[11] Patent Number: 4,514,591

[45] Date of Patent: Apr. 30, 1985

[54] GLAZE TO PIN CONNECTION FOR A HIGH VOLTAGE DIRECT CURRENT INSULATOR WITH EMBEDDED METAL FITTING

[75] Inventor: Edward S. Wheeler, Batavia, N.Y.

[73] Assignee: Interpace Corporation, Purchase, N.Y.

[21] Appl. No.: 584,885

[22] Filed: Feb. 29, 1984

[51] Int. Cl.[3] ..... H01B 17/08; H01B 17/50

[52] U.S. Cl. ..... 174/182; 174/140 C; 174/211

[58] Field of Search ..... 174/140 C, 182, 189, 174/196, 211

[56] References Cited

U.S. PATENT DOCUMENTS 2,023,808 12/1935 Hawley ..... 174/196 X
4,443,659 4/1984 Tatem ..... 174/140 C

FOREIGN PATENT DOCUMENTS 209031 7/1957 Australia ..... 174/211

OTHER PUBLICATIONS

*PINCO Insulators,* Catalog No. 49, published by The Porcelain Insulator Corporation, Lima, New York, copyright 1949, reprinted Dec. 1950, pp. 62 and 63.

*Primary Examiner*—Laramie E. Askin
*Attorney, Agent, or Firm*—Charles E. Baxley

[57] ABSTRACT

This disclosure teaches a direct current electrical insulator with improved glaze to pin electrical connection. A suitably contoured porcelain insulator shell is coated with a conventional non-conductive glaze and has a metal cap and a metal pin each situated at a surface of the insulator shell opposite to the other. The insulator shell forms a recess to receive the pin and Portland cement is poured therein for mechanically securing the pin in the insulator shell. A phenolic polymer composition is applied to cover the surface of the Portland cement to connect the pin for non-ionic current flow to the glaze and thus to accommodate passage of leakage current in a manner that generally prevents electrochemical corrosion of an anodic pin with attendant cracking of the porcelain insulator.

5 Claims, 1 Drawing Figure

GLAZE TO PIN CONNECTION FOR A HIGH VOLTAGE DIRECT CURRENT INSULATOR WITH EMBEDDED METAL FITTING

This invention relates to electrical insulators and, more particularly, to a high voltage direct current ceramic insulator with a layer of phenolic resin to inhibit electro-chemical corrosion of an embedded metal fitting.

BACKGROUND OF THE INVENTION

Electrical insulators commonly known as suspension insulators may be used individually, but usually form part of a string to support an electrical conductor from a supporting structure. Generally such a suspension insulator comprises two metal hardware members secured to opposite surfaces of a suitably contoured porcelain insulator shell, one hardware member being embedded by means of cement in a cavity in the porcelain shell. By this arrangement the metal hardware members are separated and insulated each from the other. The hardware members, typically an upper cap and a lower pin, each are secured to one of the opposite surfaces of the insulator shell usually by a layer of Portland cement or other suitable material. Typically an insulating, non-conductive glaze will cover the exposed porcelain surface.

High voltage direct current power transmission lines are known to experience cracked suspension insulators after some period of service. This cracking may be caused by an ionic current flow through the moisture in the Portland cement. Because this current flow always is in the same direction in a direct current system, the resulting electrochemical reaction causes the pin to corrode and hence to "grow" if the pin is the positive, or anodic, terminal in the insulator. This "growth", in turn, leads to tensile stresses within the ceramic insulator that produces the cracking phenomenon.

Head cracking problems have arisen on alternating current lines using suspension insulators coated with a semiconducting glaze. The cracking in that AC case has been attributed to increased leakage current due to the semiconducting glaze. As revealed in U.S. patent application Ser. No. 404,620 filed Aug. 2, 1982, now U.S. Pat. No. 4,443,659, head cracking of semiconducting glaze insulators can be greatly reduced or eliminated by use of non-ionic current conducting cementing means. AC suspension insulators used with standard insulating glazes have not generally presented head cracking problems.

According to one theory developed to explain this cracking phenomenon in direct current insulators using standard insulating glazes, adverse environmental conditions, of which moisture and contamination are typical, increase the insulator surface leakage current. When the leakage current reaches the Portland cement, it flows through it, not just over the cement surface, inasmuch as moisture from the environment is always present in the cement, thereby increasing the cement conductivity and enhancing the undesirable ionic electrochemical process of attack upon the galvanized pin.

Thus, there is a need for some means to eliminate ionic current flow through the Portland cement in insulators that have the conventional glaze which is characteristic of the high voltage direct current insulator, to prevent pin growth and consequent insulator cracking.

STATEMENT OF INVENTION

The foregoing difficulties of prior art direct current electrical insulators are solved in a particularly novel, useful and unobvious way through the teaching of the present invention. According to the present invention, Portland cement, such as neat Portland cement, is positioned in the pin recess formed by the porcelain insulator shell about the pin, thus securing the pin to the insulator shell for mechanical integrity. Then a phenolic polymer composition, containing a phenolic resin and having a nonionic electrical conductivity substantially greater than the conductivity of Portland cement, is applied to connect the metal pin electrically to the conventional insulating glaze coating in a manner which substantially prohibits air from contacting the Portland cement. The recess forms a mouth and the phenolic polymer composition preferably covers that entire mouth.

The phenolic polymer composition used in the present invention has reasonably high nonionic electrical conductivity; is resistant to the effects of weather; bonds well to glaze, cement and metal surfaces; and is relatively inexpensive and appliable conveniently in a factory. One preferred material is a conductive carbon filled phenolic resin manufactured and sold under the trademark CARBO-KOREZ by Atlas Minerals and Chemicals Company.

Therefore, a primary object of this invention is to provide a cementing arrangement, including Portland cement sealed by a phenolic resin composition, for use with direct current electrical insulators having a standard, conventional and non-semiconductive glaze coating on their porcelain insulator shells, to establish electrical connection to the hardware, without passage of significant leakage currents through the Portland cement.

It is a further object of this invention to provide a cement arrangement which has low shrinkage, so that suitable bonds are maintained between metal hardware and insulator surfaces.

It is still a further object of this invention to provide electrical insulators of the type here contemplated which are well suited otherwise to perform their intended functions. The foregoing objects as well as other objects, features and advantages of this invention will be understood more fully from the accompanying drawing, from a detailed description of a preferred embodiment and from claims which are presented herewith.

The drawing and embodiment shown therein are for illustrative purposes only and are not meant to limit or redefine the invention as disclosed and claimed herein.

DESCRIPTION OF THE PREFERRED EMBODIMENT

Figure 1:
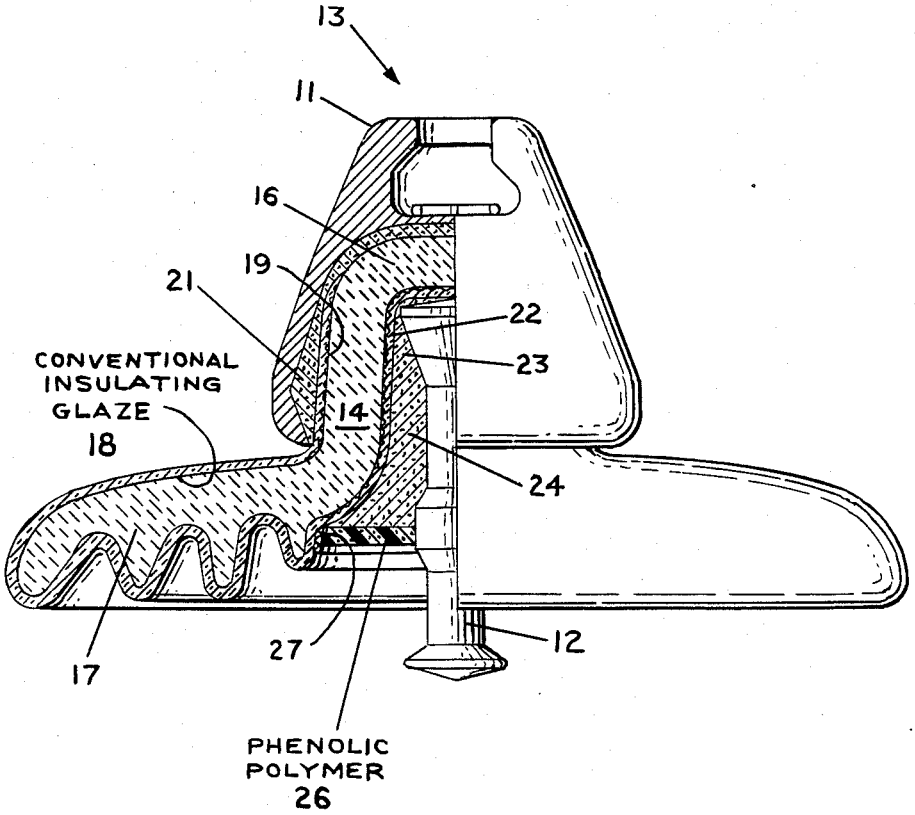
FIG. 1, the only FIGURE, is a front view of a preferred embodiment of an electrical insulator according to the present invention, the left half of the FIGURE is shown in cross section.

Referring to the FIGURE, a typical cap 11 and pin 12 type direct current electrical insulator according to the present invention is designated generally 13; however, it should be understood that the specific form of the insulator 13 is not profound so long as features essential to the invention are found therein. When assembled in a string, cap 11 is attached to a pin of an electrical insulator above it and the pin 12 is connected to a cap of an electrical insulator below it. A contoured porcelain insulator shell 14 is composed of a head 16 and a shed 17 and is coated on its exposed and sand band surfaces 19, 22 with a conventional insulating glaze 18 that is not semiconductive. The cap 11 is metal and is fixed to the sanded surface 19 of the insulator shell 14 at the outer periphery of the head 16 by capping means in the form of cement 21. The pin 12 is metal and is fixed to the sanded surface 22 of the insulator shell 14 (in a pin recess 23 formed in the head 16) by means of cement 24.

Both cement 21 and cement 24 preferably are neat Portland cement for securing mechanically and inexpensively the cap 11 and the pin 12 respectively to the insulator shell 14. The desired non-ionic electrical connection to the pin 12 is achieved by use of a phenolic polymer composition 26 such as, for example, CARBO-KOREZ, preferably placed in a mouth 27 formed in the pin recess 23. It is preferable to have the phenolic polymer composition cover the entire mouth 27. By this arrangement leakage current flow between the glaze 18 and the pin 12 is shunted around the cement 24. The leakage current is a non-ionic current that is carried by the phenolic polymer composition 26 which is not affected adversely by the passage of the leakage current therethrough. The outer organic layer, if it bonds well to the porcelain and the pin, which is a prerequisite for its conduction of leakage current, will also seal off the Portland cement from the environment and thus prevent ready replacement of the cement's moisture. In this way significant ionic conduction is stopped, further preventing pin "growth".

Various polymer compositions will perform satisfactorily in this service, including silicone greases, epoxy and silicone rubber layers and phenolic polymers filled with (for example) carbon particles. As had been mentioned above, an effective (and preferred) low cost commercial product suitable to serve as the phenolic polymer composition is available under the trademark CARBO-KOREZ corrosion proof cement sold by Atlas Minerals and Chemicals Company. The CARBO-KOREZ cement has a resistivity of about 10,000 ohm centimeters.

Accelerated long term tests have shown that direct current electrical insulators according to the present invention perform extremely well. The units were energized with direct current for up to several years with periodic inspections carried out to observe changes and to measure conductivities. The acceleration was accomplished by increasing the average leakage current per unit time over what would be normal for standard insulating glazes. Significant current flow over insulating glazes occurs only under wet, contaminated conditions, an infrequent situation normally. Use of a semiconducting glaze permits continual significant leakage current flow without regard to weather or contamination, thus accelerating the DC insulator cracking problem.

Two comparative experiments were conducted in which conventional insulating glaze insulators using conductive Portland cement in the conventional fashion were energized over a period of time. In the first experiment five tests of strings of units without the conducting organic cement layer were made with direct current for up to fifteen months with pin polarities and other test conditions and test results as shown:

EFFECTS OF ACCELERATED TESTING OF DC ENERGIZED DISC SUSPENSION INSULATORS

| Product Type | Test No. | No. of Discs Used | Polarity of pin Electrode | Months Energized | Visibly Cracked Units, % |
|---|---|---|---|---|---|
| Without Conducting Organic Cement Layer | 1 | 4 | Positive | 2.5 | 75 |
| | 2 | 4 | Positive | 6.5 | 75 |
| | 3 | 12 | Positive | 8.5 | 67 |
| | 4 | 4 | Positive | 12 | 25 |
| | 5 | 4 | Negative | 15 | 0 |

In the second experiment, six tests similar to those in the first experiment, except for the application of a conducting organic cement layer on each disc, were performed on insulators subjected to the polarities and other test conditions as shown:

EFFECTS OF ACCELERATED TESTING OF DC ENERGIZED DISC SUSPENSION INSULATORS

| Product Type | Test No. | No. of Discs Used | Polarity of pin Electrode | Months Energized | Visibly Cracked Units, % |
|---|---|---|---|---|---|
| With conducting Organic Cement layer | 6 | 4 | Negative | 4.5 | 0 |
| | 7 | 4 | Positive | 4.5 | 0 |
| | 8 | 4 | Negative | 19 | 0 |
| | 9 | 4 | Positive | 19 | 0 |
| | 10 | 4 | Positive | 28 | 0 |
| | 11 | 5 | Positive | 40 | 0 |

From the foregoing experimental data it can be seen that the preponderance of cracking of porcelains without an applied layer of conducting organic cement in direct current service is unreasonably high, with significant cracking occurring in a period of time of about two and one-half to about twelve months. The variation in time for a given percentage of units to crack is dependent upon a number of factors which vary in outdoor exposure, particularly the level of humidity present in the surrounding air during the exposure.

In contrast, however, those porcelains in direct current service to which a layer of organic cement had been applied did not show visible cracks after as much as 40 months of testing.

The above experiments involving visually obvious cracking do not entirely reveal the physical condition of the apparently intact units. When manufactured, suspension units of the type tested have mechanical-electrical strengths well above their rated strength, usually averaging about 120% or more of rating. The apparently intact units without the applied layer of organic cement were subsequently tested for their ultimate mechanical-electrical strength after the energization period. Of the units tested in this fashion, the measured strength ranged from 74% to 123% of the rated strength. As can be seen, many of the apparently intact units were in fact weakened and might eventually be expected to crack.

To demonstrate the improvement possible by the new method described in the present invention, the four units from test No. 9 were tested for ultimate mechanical and electrical strength and showed 126% to 154% of the strength rating after the 19 months energization test.

This last set of results is in strong contrast to those obtained in the first experiment and exhibits the marked superiority of this invention.

It will be evident to those skilled in design, manufacture, installation and maintenance of electrical insulators that various deviations may be made from the shown and described preferred embodiment, without departing from a main theme of invention set forth in the following claims.

I claim:

1. In an electrical insulator for use on positive polarity direct current transmission lines, comprising in combination:

a suitably contoured porcelain shell with a conventional insulating glaze;

a metal cap and a metal pin each situated at a surface of the insulator shell opposite to the other, the insulator shell forming a pin recess receiving the pin;

capping means securing mechanically the cap to the shell; and

Portland cement in the recess and about the pin securing mechanically to the shell the pin located in the recess;

the improvement comprising a phenolic polymer composition having long term weather resistance and being connected between the pin and the glaze and substantially sealing the Portland cement from contact with moisture in the air, the phenolic polymer composition having a non-ionic electrical conductivity substantially greater than the conductivity of the Portland cement.

2. The electrical insulator according to claim 1 further comprising:

the pin recess forming a mouth;

the phenolic polymer composition completely covering the mouth;

the phenolic polymer composition having good bonding to the glaze, to the Portland cement and to the metal pin.

3. The electrical insulator according to claim 2 wherein the capping means constitutes neat Portland cement.

4. The electrical insulator according to claim 1 wherein the Portland cement in the pin recess is neat Portland cement.

5. In an electrical insulator for use on positive polarity direct current transmission lines comprising in combination:

a suitably contoured porcelain shell with a conventional insulating glaze;

a metal cap and a metal pin each situated at a surface of the porcelain shell opposite to the other, the porcelain shell forming a pin recess receiving the pin;

capping means securing mechanically the cap to the shell; and

Portland cement in the recess and about the pin securing mechanically to the shell the pin located in the recess; wherein, the improvement comprises a conductive carbon-filled phenolic polymer composition which bonds to the cement and to the glaze on the porcelain shell and to the pin, the composition having long-term weather resistance and forming an electrical connection between the pin and the glaze and substantially sealing the Portland cement from contact with moisture in the air, the phenolic polymer composition having a nonionic electrical conductivity substantially greater than the conductivity of the Portland cement.

* * * * *